US010305172B2

(12) United States Patent
Noori et al.

(10) Patent No.: US 10,305,172 B2
(45) Date of Patent: May 28, 2019

(54) ELECTRONIC DEVICE WITH MILLIMETER WAVE ANTENNAS ON STACKED PRINTED CIRCUITS

(71) Applicant: Apple Inc., Cupertino, CA (US)

(72) Inventors: Basim H. Noori, Scotts Valley, CA (US); Boon W. Shiu, San Francisco, CA (US); Kevin M. Marks, San Francisco, CA (US); Matthew A. Mow, Los Altos, CA (US); Mattia Pascolini, San Francisco, CA (US); Ming-Ju Tsai, Sunnyvale, CA (US); Ruben Caballero, San Jose, CA (US); Yuehui Ouyang, Sunnyvale, CA (US); Khan Salam, Dublin, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/952,115

(22) Filed: Apr. 12, 2018

(65) Prior Publication Data

US 2018/0233808 A1 Aug. 16, 2018

Related U.S. Application Data

(63) Continuation of application No. 15/138,689, filed on Apr. 26, 2016, now Pat. No. 9,972,892.

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/2258* (2013.01); *H01Q 1/2266* (2013.01); *H01Q 1/24* (2013.01);
(Continued)

(58) Field of Classification Search
CPC ..... H01Q 1/24; H01Q 1/241; H01Q 1/242; H01Q 1/243; H01Q 1/2258; H01Q 1/2266; H01Q 19/10; H01Q 19/30; H01Q 21/065
See application file for complete search history.

(56) References Cited

U.S. PATENT DOCUMENTS 7,812,775 B2 10/2010 Babakhani et al.
8,854,277 B2 10/2014 De Graauw et al.
(Continued)

FOREIGN PATENT DOCUMENTS

CN 101728369 A 6/2010
CN 102255134 A 11/2011
(Continued)

*Primary Examiner* — Hoang V Nguyen
(74) *Attorney, Agent, or Firm* — Treyz Law Group, P.C.; G. Victor Treyz; Joseph F. Guihan

(57) ABSTRACT

An electronic device may be provided with wireless circuitry. The wireless circuitry may include one or more antennas and transceiver circuitry such as millimeter wave transceiver circuitry. The antennas may be formed from metal traces on a printed circuit. The printed circuit may be a stacked printed circuit including multiple stacked substrates. Metal traces may form an array of patch antennas, Yagi antennas, and other antennas. Antenna signals associated with the antennas may pass through an inactive area in a display and through a dielectric-filled slot in a metal housing for the electronic device. Waveguide structures may be used to guide antenna signals within interior portions of the electronic device.

20 Claims, 17 Drawing Sheets

(51) Int. Cl.

| | |
|---|---|
| ***H01Q 19/10*** | (2006.01) |
| ***H01Q 19/30*** | (2006.01) |
| ***H01Q 21/06*** | (2006.01) |
| ***H01Q 13/06*** | (2006.01) |
| *H01Q 21/28* | (2006.01) |

(52) U.S. Cl.

CPC ..... *H01Q 1/241* (2013.01); *H01Q 1/242* (2013.01); *H01Q 13/06* (2013.01); *H01Q 19/10* (2013.01); *H01Q 19/30* (2013.01); *H01Q 21/065* (2013.01); *H01Q 21/28* (2013.01)

(56) References Cited

U.S. PATENT DOCUMENTS

| | | | | |
|---|---|---|---|---|
| 8,896,487 | B2 | 11/2014 | Chiang et al. | |
| 2006/0238420 | A1 | 10/2006 | Jansen | |
| 2009/0315785 | A1 | 12/2009 | Yang | |
| 2011/0006953 | A1* | 1/2011 | Chiang | G06F 1/1616 343/702 |
| 2012/0223866 | A1* | 9/2012 | Ayala Vazquez | H01Q 1/243 343/702 |
| 2013/0048347 | A1 | 2/2013 | Shiu et al. | |
| 2013/0069837 | A1 | 3/2013 | Cozzolino et al. | |
| 2013/0294485 | A1 | 11/2013 | Ford | |
| 2014/0361945 | A1 | 12/2014 | Misra et al. | |
| 2014/0361946 | A1* | 12/2014 | Ganchrow | H01Q 9/285 343/795 |
| 2015/0035714 | A1 | 2/2015 | Zhou | |
| 2016/0056544 | A1 | 2/2016 | Garcia et al. | |

FOREIGN PATENT DOCUMENTS

| | | | |
|---|---|---|---|
| CN | 102709684 | A | 10/2012 |
| CN | 104185926 | A | 12/2014 |
| JP | 2010272959 | A | 12/2010 |

* cited by examiner

ELECTRONIC DEVICE WITH MILLIMETER WAVE ANTENNAS ON STACKED PRINTED CIRCUITS

This application is a continuation of U.S. patent application Ser. No. 15/138,689, filed Apr. 26, 2016, which is hereby incorporated by reference herein in its entirety. This application claims the benefit of and claims priority to U.S. patent application Ser. No. 15/138,689, filed Apr. 26, 2016.

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave communications bands. Millimeter wave communications, which are sometimes referred to as extremely high frequency (EHF) communications, involve communications at frequencies of about 10-400 GHz. Operation at these frequencies may support high bandwidths, but may raise significant challenges. For example, millimeter wave communications are often line-of-sight communications and can be characterized by substantial attenuation during signal propagation.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas and transceiver circuitry such as millimeter wave transceiver circuitry.

The antennas may be formed from metal traces on a printed circuit. The printed circuit may be a stacked printed circuit including multiple stacked substrates. Metal traces may form an array of patch antennas, Yagi antennas, and other antennas. The use of a staked printed circuit to support the metal traces may allow antenna radiation patterns to be oriented in a variety of directions. For example, antenna radiation patterns may be oriented vertically, diagonally, etc.

Antenna signals associated with the antennas may pass through an inactive area in a display and through a dielectric-filled slot in a metal housing for the electronic device. Beam steering operations may be performed using an array of the antennas. Waveguide structures may be used to guide antenna signals within interior portions of the electronic device.

DETAILED DESCRIPTION

Figure 1:
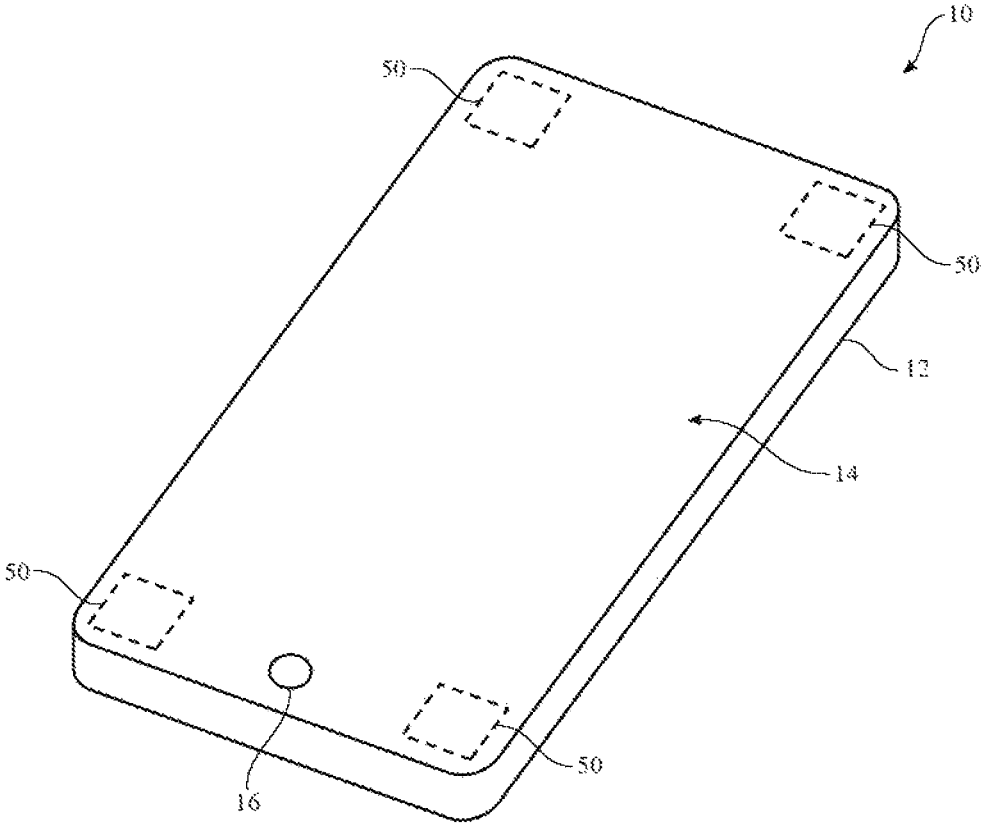
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave communications. Millimeter wave communications, which are sometimes referred to as extremely high frequency (EHF) communications, involve signals at 60 GHz or other frequencies between about 10 GHz and 400 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
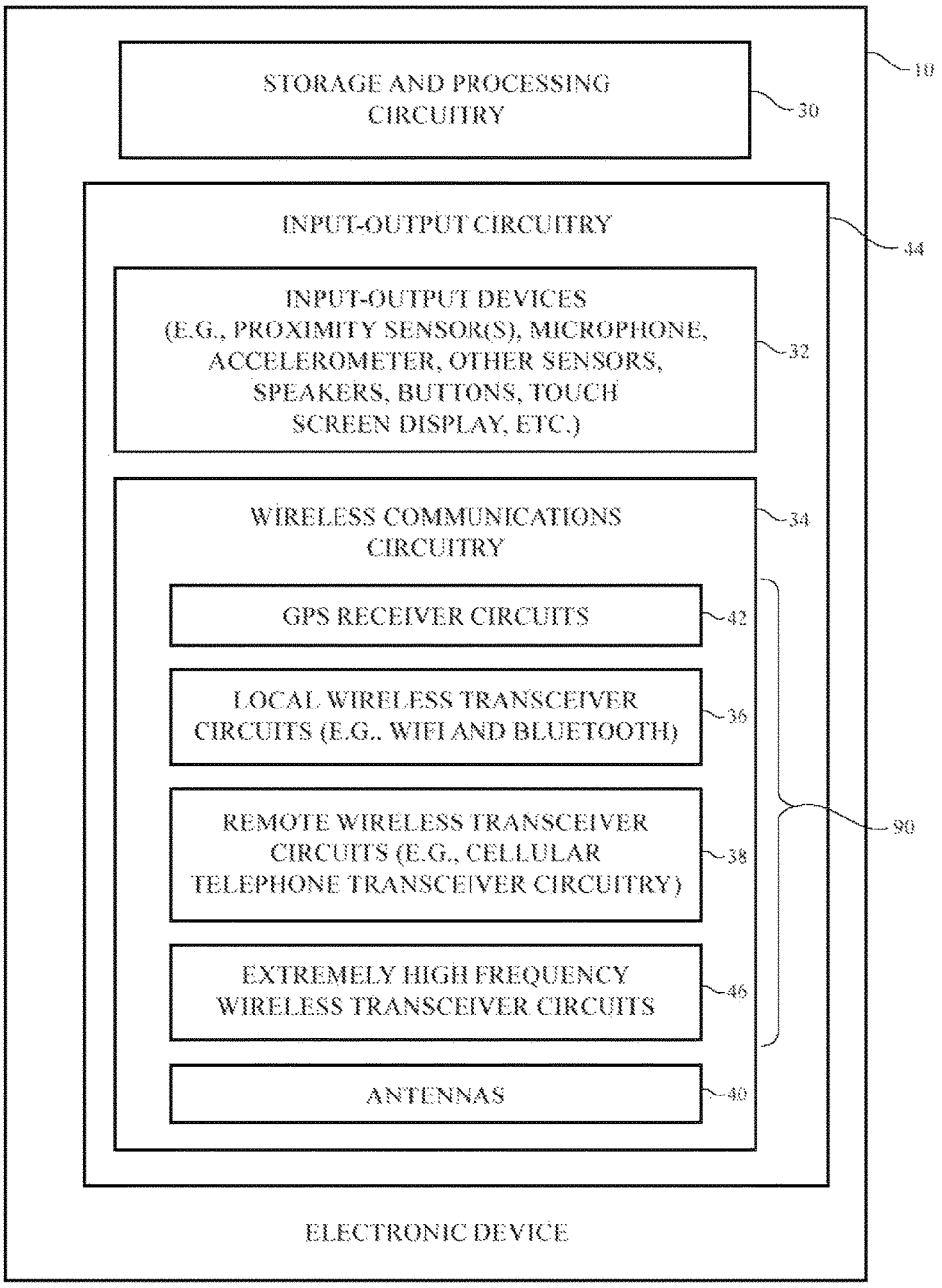
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10, such as internet browsing applications, voice-over-internet-protocol (VOIP) telephone call applications, email applications, media playback applications, operating system functions, etc. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, a connector port sensor or other sensor that determines whether device 10 is mounted in a dock, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, 42, and 46.

Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band.

Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data.

Millimeter wave transceiver circuitry 46 (sometimes referred to as extremely high frequency transceiver circuitry) may support communications at extremely high frequencies (e.g., millimeter wave frequencies such as extremely high frequencies of 10 GHz to 400 GHz or other millimeter wave frequencies). For example, circuitry 46 may support IEEE 802.11ad communications at 60 GHz.

Wireless communications circuitry 34 may include satellite navigation system circuitry such as Global Positioning System (GPS) receiver circuitry 42 for receiving GPS signals at 1575 MHz or for handling other satellite positioning data (e.g., GLONASS signals at 1609 MHz). Satellite navigation system signals for receiver 42 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 46 may convey signals over these short distances that travel between transmitter and receiver over a line-of-sight path. To enhance signal reception for millimeter wave communications, phased antenna arrays and beam steering techniques may be used. Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays for handling millimeter wave communications.

Transmission line paths may be used to route antenna signals within device 10. For example, transmission line paths may be used to couple antenna structures 40 to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 30 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter wave signals for extremely high frequency wireless transceiver circuits 46 may be implemented as phased antenna arrays. The radiating elements in a phased antenna array for supporting millimeter wave communications may be patch antennas, dipole antennas, Yagi antennas (sometimes referred to as beam antennas), or other suitable antenna elements. Transceiver circuitry can be integrated with the phased antenna arrays to form integrated phased antenna array and transceiver circuit modules.

In devices such as handheld devices, the presence of an external object such as the hand of a user or a table or other surface on which a device is resting has a potential to block wireless signals such as millimeter wave signals. Accordingly, it may be desirable to incorporate multiple phased antenna arrays into device 10, each of which is placed in a different location within device 10. With this type of arrangement, an unblocked phased antenna array may be switched into use and, once switched into use, the phased antenna array may use beam steering to optimize wireless performance. Configurations in which antennas from one or more different locations in device 10 are operated together may also be used.

Figure 3:
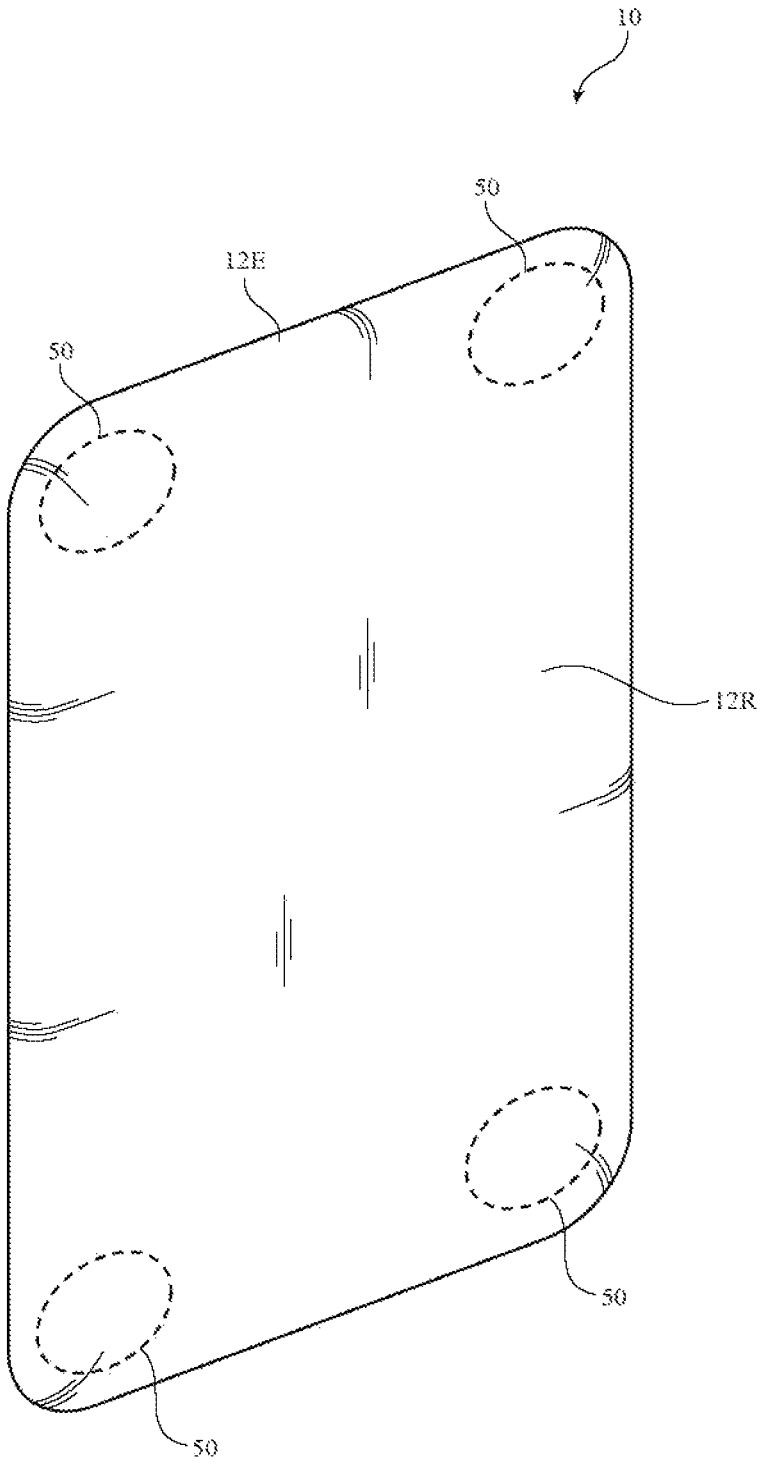
FIG. 3 is a rear perspective view of an illustrative electronic device showing illustrative locations at which antenna arrays for millimeter wave communications may be located in accordance with an embodiment.

FIG. 3 is a perspective view of electronic device showing illustrative locations 50 on the rear of housing 12 in which antennas 40 (e.g., single antennas and/or phased antenna arrays for use with wireless circuitry 34 such as millimeter wave wireless transceiver circuitry 46) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), etc. As shown in FIG. 3, for example, antennas 40 may be located at the corners of housing 12 (i.e., locations 50 may be formed on the upper left corner, upper right corner, lower left corner, and lower right corner of the rear of housing 12 and device 10).

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment.

In devices with phased antenna arrays, circuitry 90 may include gain and phase adjustment circuitry that is used in adjusting the signals associated with each antenna 40 in an array (e.g., to perform beam steering). Switching circuitry may be used to switch desired antennas 40 into and out of use. Each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
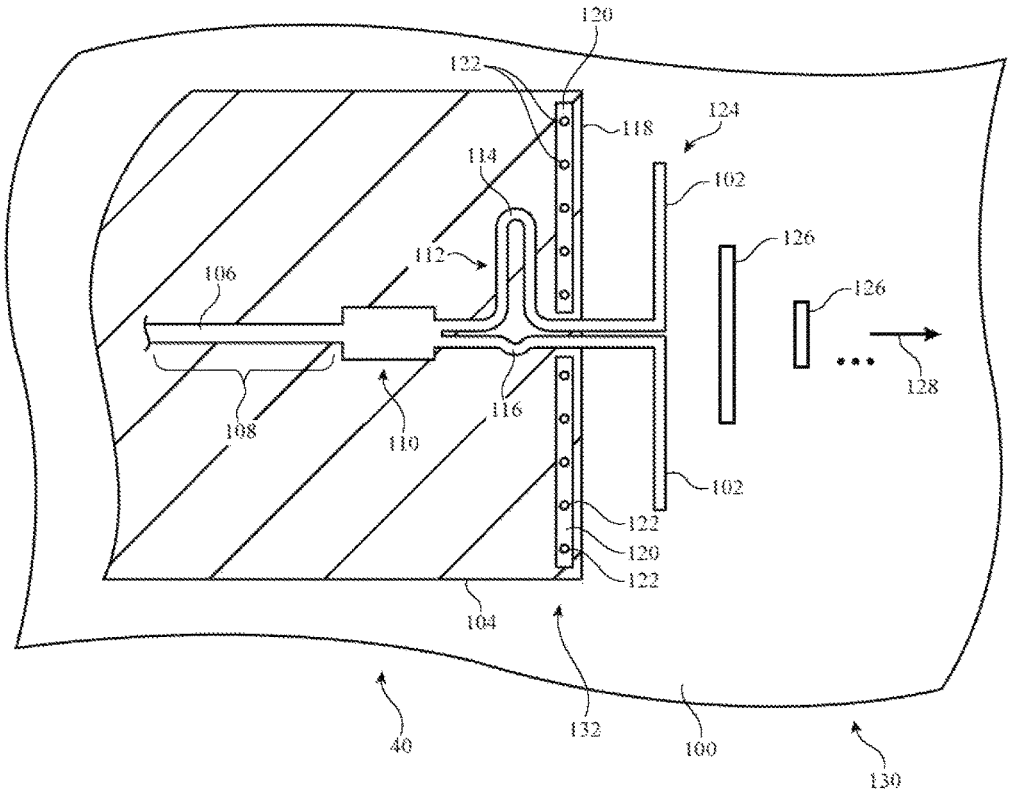
FIG. 4 is a diagram of an illustrative Yagi antenna of the type that may be used in an electronic device in accordance with an embodiment.

Antennas 40 may have any suitable configuration. In the illustrative configuration of FIG. 4, for example, antenna 40 is a Yagi antenna. As shown in FIG. 4, antenna 40 may be a Yagi printed circuit board antenna formed from printed circuit board 130. Printed circuit board 130 may have a printed circuit substrate such as substrate 100. Substrate 100 may be a rigid printed circuit board substrate (e.g., a substrate formed from fiberglass-filled epoxy or other rigid printed circuit board substrate material) or may be a flexible printed circuit substrate (e.g., a substrate formed from a sheet of flexible polymer such as a flexible polyimide layer). Substrate 100 may be formed from one or more dielectric layers. Other types of substrate may be used as a support structure for antenna 40, if desired. The configuration of FIG. 4 in which substrate 100 is a printed circuit board substrate (i.e., in which printed circuit 130 is a rigid printed circuit board) is merely illustrative.

Yagi antenna 40 includes reflector 132, radiator 124, and one or more directors 126. Radiator (driven element) 124 may be formed from dipole resonating element arms 102 and may transmit and receive antenna signals during operation of antenna 40. The presence of reflector 132 and directors 126 enhances the directionality of antenna 40 so that the radiation pattern for antenna 40 is directed in a desired direction, such as direction 128.

Printed circuit board 130 may contain one or more patterned layers of metal traces for forming antenna 40. For example, directors 126 and dipole arms 102 of radiator 124 may be formed from strip-shaped metal traces (i.e., parallel strips of metal) on substrate 100. Antenna signals may be conveyed between transceiver circuitry 90 and antenna 40 using a transmission line path such as transmission line 108 that is formed from metal trace 106 and ground plane 104. In portion 112 of antenna 40, path 114 is longer than path 116 to impose a 180° phase shift on the signals passing through path 116 for satisfactory Yagi antenna operation. Portion 110 of the signal path feeding antenna 40 may be widened relative to other traces 106 in transmission line 108 to form a transformer impedance that helps match the impedance of transmission line 108 (e.g., 50 ohms) to the impedance of radiator 124 (e.g., 170-180 ohms).

Edge 118 of ground plane 104 may run parallel to arms 102 of radiator 124 and may be used in forming reflector 132. Reflector 132 may also include optional metal traces (e.g., metal traces in another layer of printed circuit 130) such as strip-shaped metal traces 120. Metal traces 120 may be shorted to ground 104 through vias 122 that pass through one or more layers of printed circuit board material in substrate 100.

Figure 5:
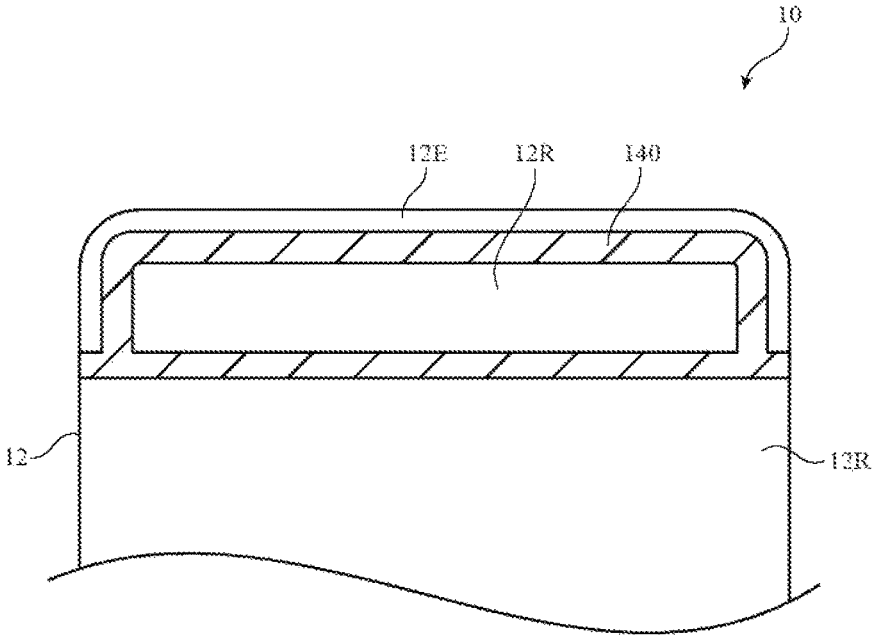
FIG. 5 is a rear view of illustrative electronic device with a metal housing and dielectric such as plastic-filled slots in the housing to accommodate wireless circuitry in accordance with an embodiment.

A rear view of device 10 in an illustrative configuration in which housing 12 (e.g., rear housing wall 12R and/or housing sidewall 12E) has been formed from metal is shown in FIG. 5. In the example of FIG. 5, device 10 includes dielectric-filled slots (gaps) 140 that separate portions of rear housing wall 12R and/or sidewall housing wall 12E from each other. There are two elongated slots 140 at one illustrative end of housing 12 in the example of FIG. 5, but this is merely illustrative. There may be one elongated strip-shaped opening in metal housing 12, two elongated strip-shaped openings in metal housing 12, or three or more strip-shaped openings in metal housing 12, or other patterns of slots or other openings. These patterns of openings (e.g., the slots of FIG. 5) may be formed at one or both ends of housing 12. Gaps and other openings in housing 12 may also have non-elongated shapes, may have shapes with combinations of straight and curved edges, may form rectangular areas, may form circular areas, or may form areas with other shapes. These openings in housing 12 may pass entirely through the metal wall structure that forms housing 12 (e.g., these openings may pass from an outer surface of housing wall 12 to an inner surface of housing wall 12). If desired, a metal housing in device 10 may also include shallow grooves or other regions that have plastic or other dielectric but that do not pass entirely through the metal housing.

Portions of dielectric-filled slots that pass through housing 12 such as illustrative slots 140 of FIG. 5 may electrically isolate different portions of housing 12 from each other and thereby allow these portions of housing 12 to serve as conductive structures in antennas (e.g., resonating element arms in inverted-F antennas, portions of slot antennas, resonating element structures in hybrid antennas, antenna ground structures, etc.) for cellular telephone bands, wireless local area network bands, satellite navigation system bands, other bands between 700 MH and 2700 MHz, and/or other suitable frequencies. Because slots 140 are filled with dielectric, these slots or other dielectric openings in a metal housing can also serve as antenna windows for antennas 40 such as illustrative Yagi antenna 40 of FIG. 4 (i.e., antenna signals associated with antennas in device 10 may pass through slots 140). Yagi antennas such as Yagi antenna 40 of FIG. 4 may operate at frequencies of 60 GHz, other extremely high frequencies (EHF) such as frequencies of 10-400 GHz (sometimes referred to as millimeter wave frequencies), or other suitable operating frequencies.

Figure 6:
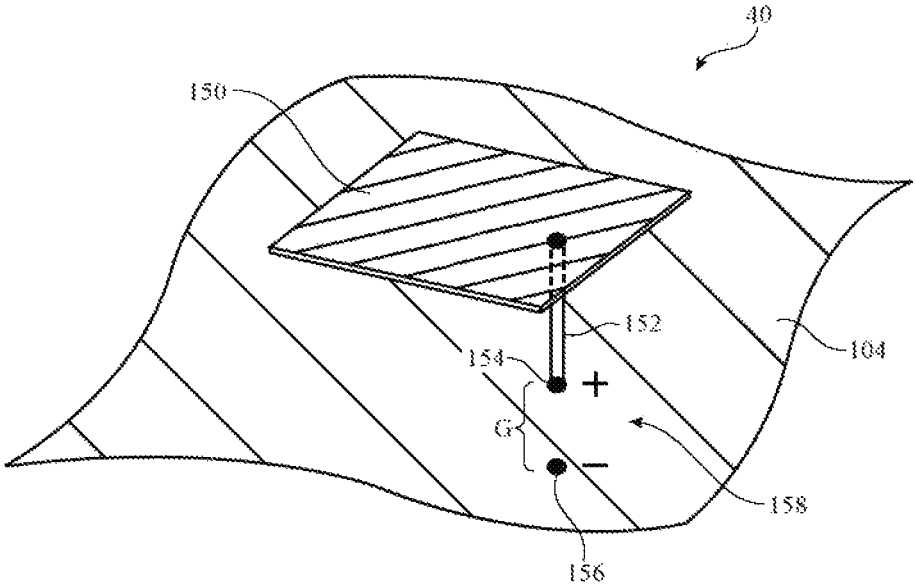
FIG. 6 is a perspective view of an illustrative patch antenna that may be used in an electronic device in accordance with an embodiment.

If desired, antennas 40 in device 10 may include patch antennas. An illustrative patch antenna for device 10 is shown in FIG. 6. Patch antenna 40 of FIG. 6 may operate at frequencies of 60 GHz, other extremely high frequencies (EHF) such as frequencies of 10-400 GHz (sometimes referred to as millimeter wave frequencies), or other suitable operating frequencies. As shown in FIG. 6, patch antenna 40 may have a patch antenna resonating element such as patch antenna resonating element 150. Patch antenna resonating element 150 may be a planar metal structure that is supported on a dielectric support structure such as a printed circuit board substrate, plastic carrier, etc. Patch antenna resonating element 150 may have a rectangular shape, may have a square shape, may have an oval shape, may have a circular shape, or may have other suitable shapes. In the example of FIG. 6, element 150 lies in a plane that is parallel to the plane of antenna ground plane 104. Antenna 40 may be fed using feed 158. Feed 158 may include positive antenna feed terminal 154 and ground antenna feed terminal 156. Path 152 may be used to couple terminal 154 to patch element 150. Terminal 156 may be coupled to ground 104. If desired, antenna 40 may have multiple feeds in different locations and may support multiple frequency resonances (e.g., using a rectangular resonating element patch with sides of different respective lengths), may exhibit multiple polarizations, and/or may exhibit other desired antenna attributes.

Figure 7:
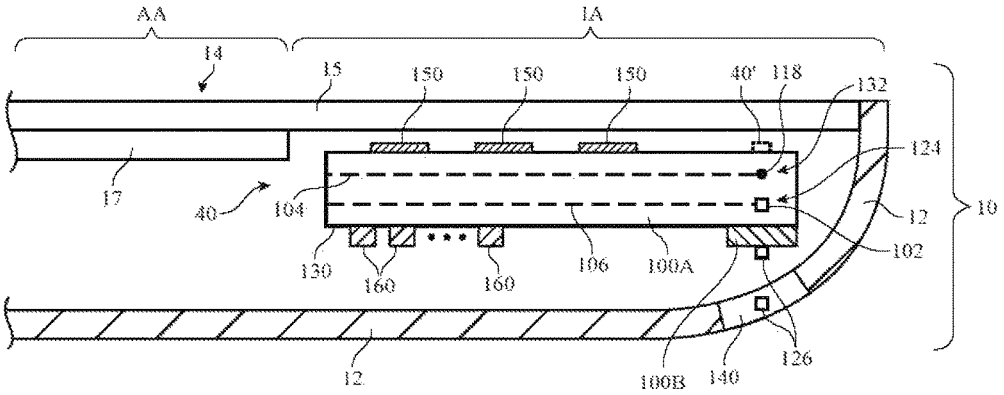
FIG. 7 is a cross-sectional side view of an illustrative electronic device with antennas mounted on a support structure such as a stacked printed circuit board in accordance with an embodiment.

FIG. 7 is a cross-sectional side view of an illustrative electronic device of the type that may be provided with antennas 40. In the example of FIG. 7, display 14 includes display cover layer 15 (e.g., a clear layer of plastic, glass, etc.) and includes display structures 17 for producing images for a user. Display structures 17 may form a liquid crystal display, an electrophoretic display, a light-emitting diode display such as an organic light-emitting diode display, or other suitable display. Display structures 17 may have an array of pixels for displaying images for a user and may form active area AA of display 14. Inactive area IA of display 14 is free of pixels and may be located along the periphery of display 14.

Antennas 40 may be located in any suitable portion of device 10. For example, antennas 40 may be located under inactive area IA of display 14. With this type of arrangement, antenna signals can pass through display cover layer 15 (e.g., a clear dielectric layer such as glass or plastic) in inactive area IA. Antenna signals can also pass through dielectric-filled slots 140 or other dielectric-filled openings in metal housing 12.

As shown in the illustrative example of FIG. 7, antennas 40 may include or more patch antennas. Each patch antenna may have a respective patch antenna resonating element 150. Display cover layer 15 may have a planar lower surface. Patch antenna resonating elements 150 may lie in a plane parallel to the planar lower surface associated with display cover layer 15. There may be one or more patch antennas in inactive area IA. For example, there may be an array of patch antennas having 1-5 rows and/or 1-5 columns of patch antenna resonating elements 150, there may be 1-20 resonating elements 150, more than five elements 150, fewer than 25 elements 150, more than seven elements 150, or other suitable number of patch antenna resonating elements 150. Each element 150 and a corresponding portion of antenna ground 104 may form a patch antenna that is fed using a separate transmission line (as an example). The patch antennas in an array of this type may be used to implement beam steering.

Antennas 40 may include one or more Yagi antennas or other antennas with a radiator formed from dipole radiating elements such as traces 102. Traces 102 of radiator 124 may be coupled to antenna signal path 106. Each Yagi antenna may have a reflector such as reflector 132 (see, e.g., ground plane edge 118 of ground 104) and may have one or more directors 126. Directors 126, radiator 124, and reflector 132 may be formed from metal traces on dielectric support structures such as printed circuit substrates and other support structures such as printed circuit 130 and/or may be embedded within plastic or other dielectric in an opening in housing 12, as shown by director 126 in dielectric-filled slot 140 of FIG. 7. The direction in which reflector 132, radiator 124, and directors 126 are oriented may help establish a desired radiation pattern direction for the Yagi antenna. If desired, Yagi radiating elements or other antenna elements (directors, reflectors, other resonating elements, etc.) may also be located on the upper surface of printed circuit 130, as shown by illustrative antenna location 40'.

Antennas 40 may be supported using a support structures such as printed circuit 130 or other support structures. Patterned metal traces (e.g., photolithographically patterned traces) may be used in forming patches 150, ground 104, reflector 132, signal path 106, radiator 102, directors 126, and/or other antenna structures. The substrate(s) of printed circuit 130 may have layers of printed circuit material and the patterned metal traces may be formed on the surfaces of printed circuit 130 and/or may be embedded within the layers that make up printed circuit 130. Integrated circuits and other components 160 (e.g., circuitry for transceiver circuitry 90 or other circuitry in device 10) may be mounted on printed circuit 130 and may be coupled to antenna structures 40 (e.g., using traces such as ground trace 104 and signal trace 106).

Printed circuit 130 may be a stacked printed circuit. For example, printed circuit 130 may be formed from printed circuit substrate 100A and additional substrate(s) such as printed circuit substrate 100B that are stacked on substrate 100A. Printed circuit substrate 100A and additional stacked substrates such as printed circuit substrate 100B may be flexible printed circuit substrates and/or rigid printed circuit board substrates. Solder, adhesive, and/or other attachment structures may be used to couple printed circuit boards 100A and 100B together to form stacked printed circuit 130. An advantage of using stacked printed circuit structures is that this helps support antenna structures close to dielectric-filled slot 140 or other antenna windows in device 10. In the configuration of FIG. 7, for example, one of directors 126 in a Yagi antenna has been formed on the outermost (lowermost) surface of printed circuit substrate 100B, thereby placing this director 126 in a desired location adjacent to dielectric-filled slot 140. Directors 126 may be aligned vertically with slot 140 (as shown in FIG. 7) or may have other orientations to help direct antenna signals in desired directions. In the FIG. 7 configuration, directors 126 are arranged so as to align the radiation pattern of the Yagi antenna with slot 140, thereby enhancing the ability of the Yagi antenna to handle antenna signals that pass through slot 140.

Figure 8:
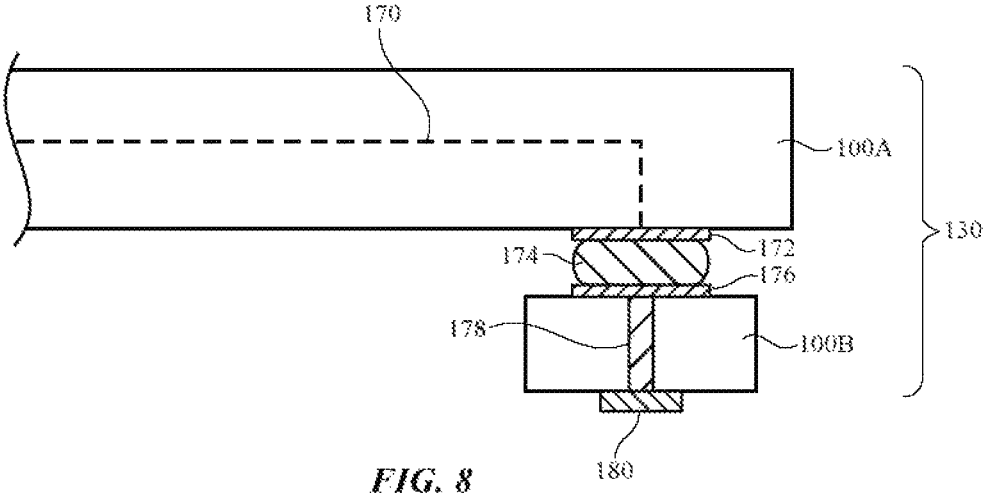
FIG. 8 is a cross-sectional side view of an illustrative printed circuit board with multiple stacked printed circuit board substrates that are attached to each other using solder in accordance with an embodiment.

FIG. 8 is a cross-sectional side view of illustrative printed circuit substrates 100A and 100B showing how metal traces in one substrate (e.g., traces 170 in substrate 100A) may be coupled by metal traces such as metal pad 172 and solder 174 to metal traces such as metal pad 176, via 178, and metal antenna trace 180 (e.g., a director, resonating element, or other antenna structure) on another substrate (e.g., substrate 100B). One or more solder joints may be used to couple printed circuit substrate layers such as layers 100A and 100B together. The single solder joint formed from solder ball 174 of FIG. 8 is merely illustrative.

Figure 9:
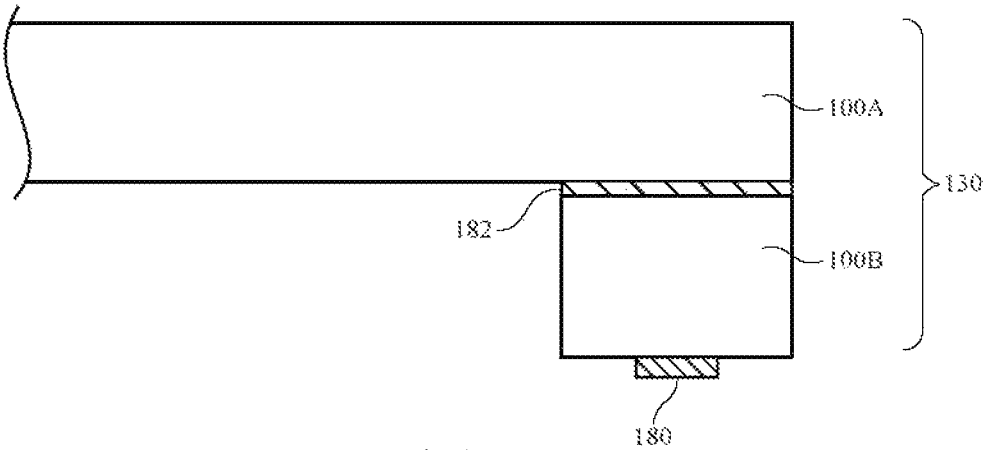
FIG. 9 is a cross-sectional side view of an illustrative printed circuit board with multiple stacked printed circuit boar substrates that are attached to each other using adhesive in accordance with an embodiment.

If desired, printed circuit substrate layers in a stacked printed circuit may be coupled using adhesive. As shown in the cross-sectional side view of stacked printed circuit 132 of FIG. 9, substrates such as printed circuit substrate 100A and printed circuit substrate 100B may be joined using adhesive 182 (e.g., pressure sensitive adhesive, cured liquid adhesive, etc.). Metal antenna traces 180 may be formed in stacked printed circuit substrate 100B (e.g., to form a director, resonating element, etc.). Metal antenna traces may also be formed within printed circuit substrate 100A, as described in connection with FIG. 7.

Figure 10:
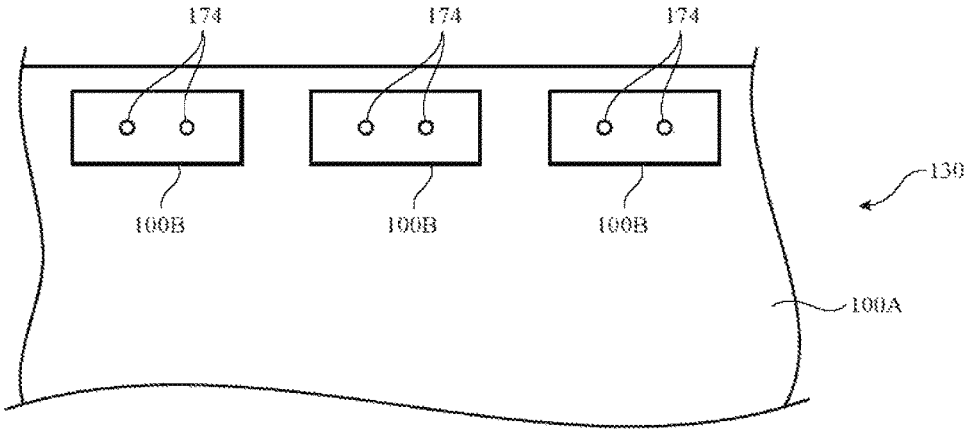
FIG. 10 is a top view of an illustrative set of printed circuit board substrates each of which has a set of solder joints to couple that printed circuit board substrate to another substrate in a stacked printed circuit in accordance with an embodiment.

A top view of an illustrative set of printed circuit substrates 100B stacked on a common printed circuit substrate 100A is shown in FIG. 10. There may be two solder joints 174 per substrate 100B (e.g., to accommodate two arms in a dipole radiator such as arms 102 of radiator 124 of FIG. 4).

Figure 11:
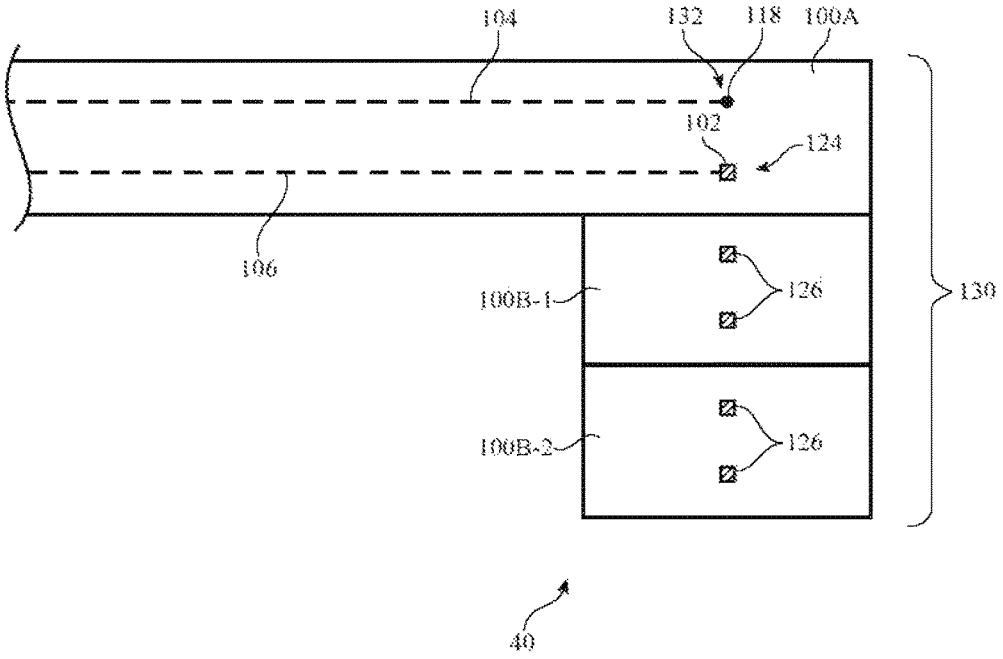
FIG. 11 is a cross-sectional side view of an illustrative printed circuit Yagi antenna formed using multiple stacked printed circuit board substrates in accordance with an embodiment.

FIG. 11 is a cross-sectional side view of printed circuit 130 in an illustrative configuration in which more than two printed circuit substrates have been stacked to form stacked printed circuit 130. As shown in FIG. 11, printed circuit 130 may include printed circuit substrates 100A, 100B-1, and 100B-2. Metal traces for a Yagi antenna or other antenna 40 may be incorporated into printed circuit 130, such as ground trace 104 for forming reflector 132, signal trace 106 and trace 102 of radiator 124, and directors 126. The use of additional stacked printed circuit substrates allows antenna structures to be extended towards slot 140 in housing 12 and/or to be otherwise used to enhance antenna performance. In the example of FIG. 11, directors 126 have been embedded within printed circuit substrates 100B-1 and 100B-2. This is merely illustrative. Any suitable metal traces for an antenna may be supported by substrates 100A, 100B-1, and 100B-2 and/or other substrates in stacked printed circuit 130. If desired, printed circuit 130 may include more than three stacked substrates. The use of three stacked substrates is shown in FIG. 11 as an example.

Figure 12:
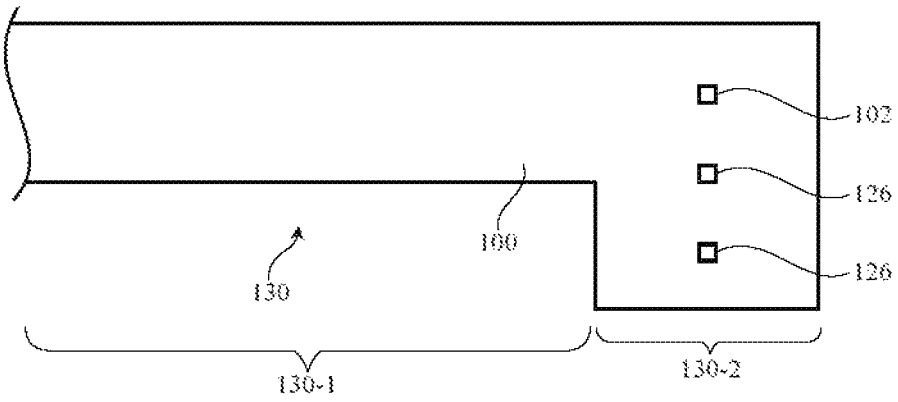
FIG. 12 is a cross-sectional side view of an illustrative printed circuit antenna having a locally raised area in accordance with an embodiment.

If desired, printed circuit 130 may have integral portions with different thicknesses such as thinner region 130-1 of FIG. 12 and thicker region 130-2 of FIG. 12. The presence of thicker region 130-2 may be used to align directors 126 with opening 140, may be used to help place directors 126 or other antenna structures closer to opening 140 than would otherwise be possible, or may otherwise be used to allow antenna structures to be arranged within the interior of device 10 so as to enhance antenna performance. Substrate 100 of printed circuit 130 may include a multiple alternating layers of dielectric and metal traces in regions 130-1 and/or region 130-2.

Figure 13:
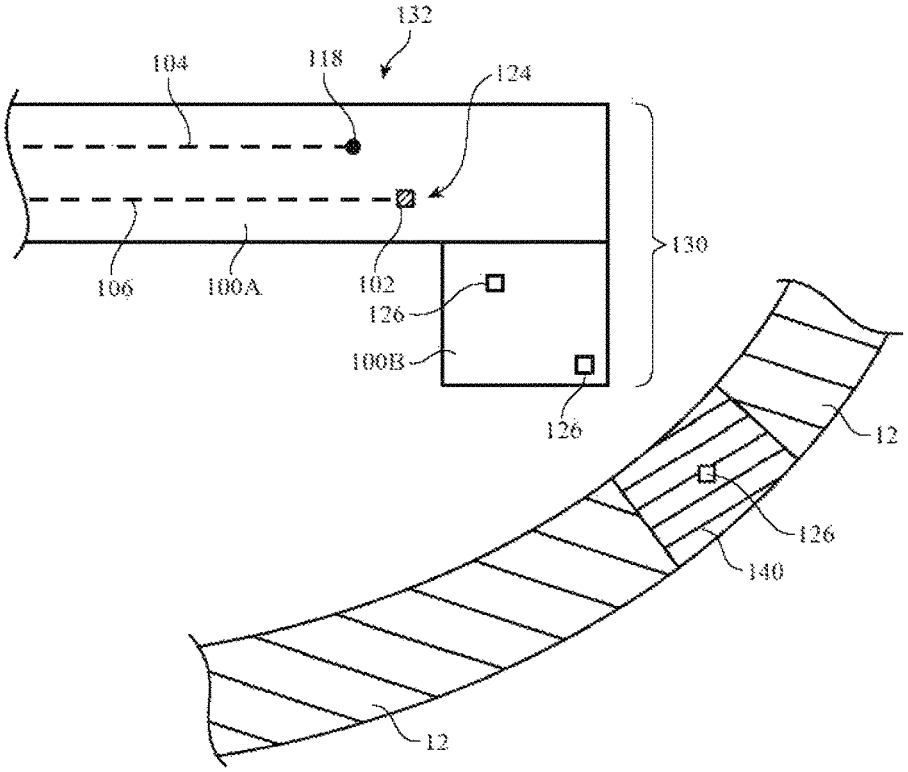
FIG. 13 is a cross-sectional side view of an illustrative Yagi antenna formed from antenna traces on a stacked printed circuit board and a metal structure in a dielectric-filled opening in an electronic device housing in accordance with an embodiment.

In the illustrative example of FIG. 13, a Yagi antenna has been provided with diagonally oriented directors 126. One of directors 126 has been embedded within dielectric (e.g., plastic) in slot 140. The Yagi antenna of FIG. 13 also includes reflector 132 and radiator 124, formed from metal traces in substrate 100A. Two of directors 126 have been embedded within printed circuit substrate 100B. Substrate 100B has been stacked with substrate 100A to form stacked printed circuit 130. The diagonal orientation of the Yagi antenna of FIG. 13 may help Yagi antenna signals to pass through a slot such as slot 140 of FIG. 13 on a curved sidewall of housing 12 or may be used in other device configurations. The example of FIG. 13 is merely illustrative.

Figure 14:
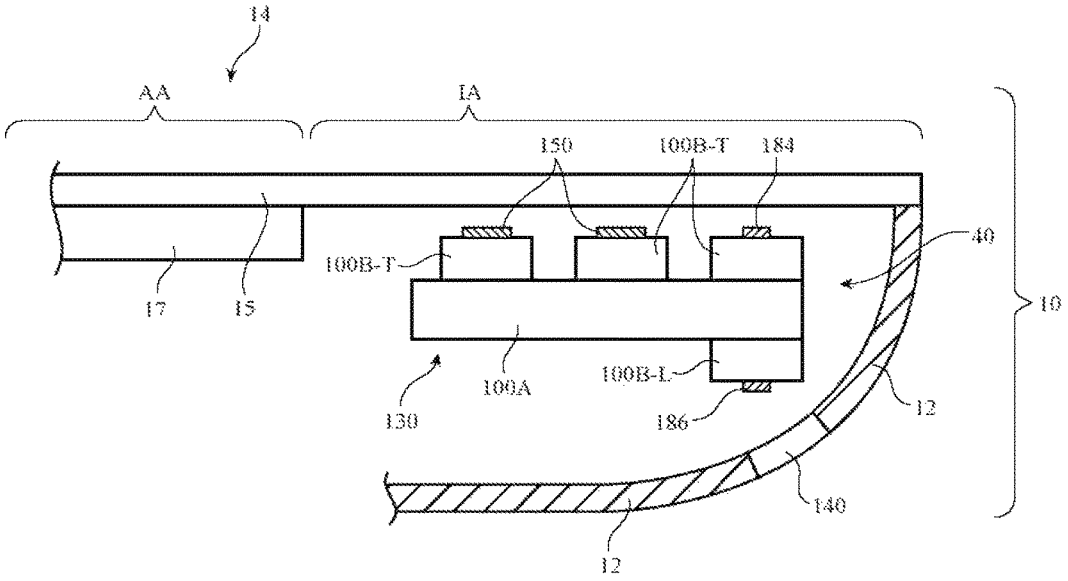
FIG. 14 is a cross-sectional side view of an illustrative electronic device with millimeter wave antennas formed from metal traces on a stacked printed circuit board in accordance with an embodiment.

As shown in the illustrative configuration for device 10 of FIG. 14, antenna structures 40 such as patch antennas formed from resonating elements 150 on stacked substrates may be mounted under inactive area IA of display 14. In stacked printed circuit 130 of FIG. 14, printed circuit substrates 100B-T have been stacked on the upper surface of substrate 100A (e.g., using solder, adhesive, etc.) and printed circuit substrate 100B-L has been stacked on the lower surface of substrate 100A. This arrangement allows patch antenna resonating elements 150 to be placed adjacent to the underside of display cover layer 15 in display 14 while allowing antenna structures such as illustrative structure 186 (e.g., structures associated with a director, reflector, or radiator in a Yagi antenna, a resonating element in a patch antenna or other antenna, or other antenna structures) to be located adjacent to slot 140. In addition to helping align antenna structures such as antenna structure 186 with slot 140, stacked printed circuit substrates such as one of stacked substrates 100B-T may help place structures such as antenna structure 184 in a desired position under display cover layer 15 on the front face of device 10. Structures such as structure 184 may be structures associated with a director, reflector, or radiator in a Yagi antenna, a resonating element in a patch antenna or other antenna, or other antenna structures.

Figure 15:
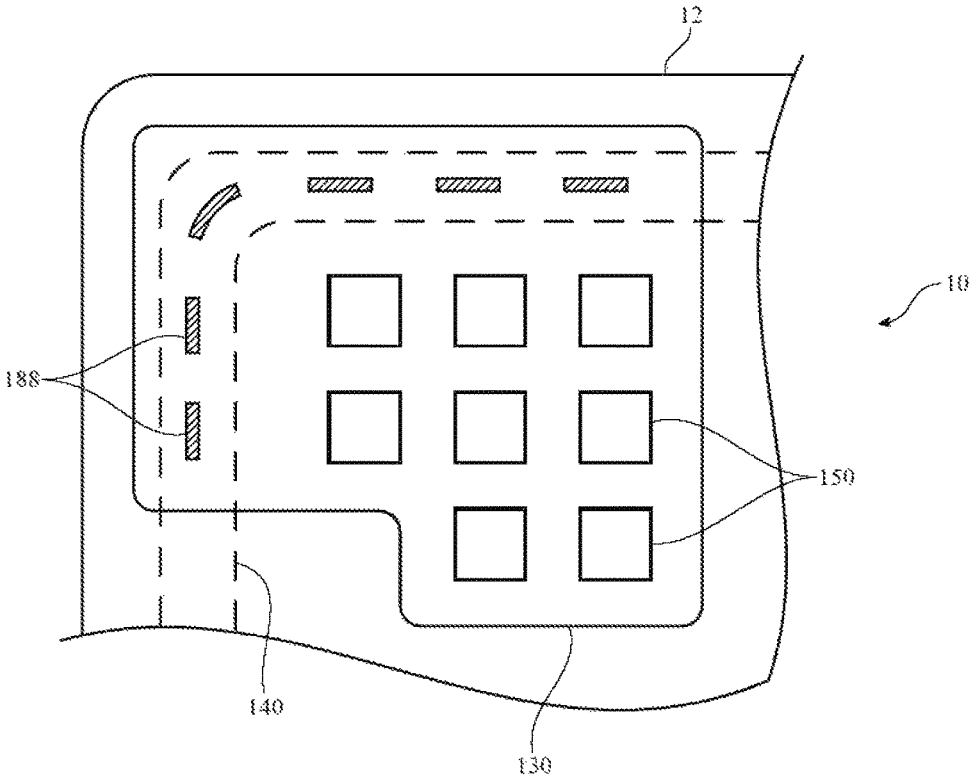
FIG. 15 is a top view of a corner portion of an illustrative electronic device showing how antennas may be arranged relative to a dielectric-filled slot in a metal housing for the electronic device in accordance with an embodiment.

FIG. 15 is a top view of an illustrative corner portion of device 10 showing how antenna structures may be aligned with slot 140 in housing 12. Patch antenna resonating elements 150 may be arranged in an array (e.g., a beam steering array) on the upper surface of printed circuit 130 and may operate through overlapping portions of display cover layer 15 in inactive area IA of display 14. Antenna structures 188 may be arranged in a row that runs along the length of slot 140. Slot 140 may have curved portions such as right-angle bends to accommodate the corners of housing 12 or may have other suitable shapes. Antenna structures 188 may be associated with patch antennas, dipole antennas, other resonating elements, Yagi antennas (e.g., directors, reflectors, and/or radiators), and/or may be associated with other suitable antennas. Antenna structures 188 may form a beam steering array of antennas that operate through slot 140.

Figure 16:
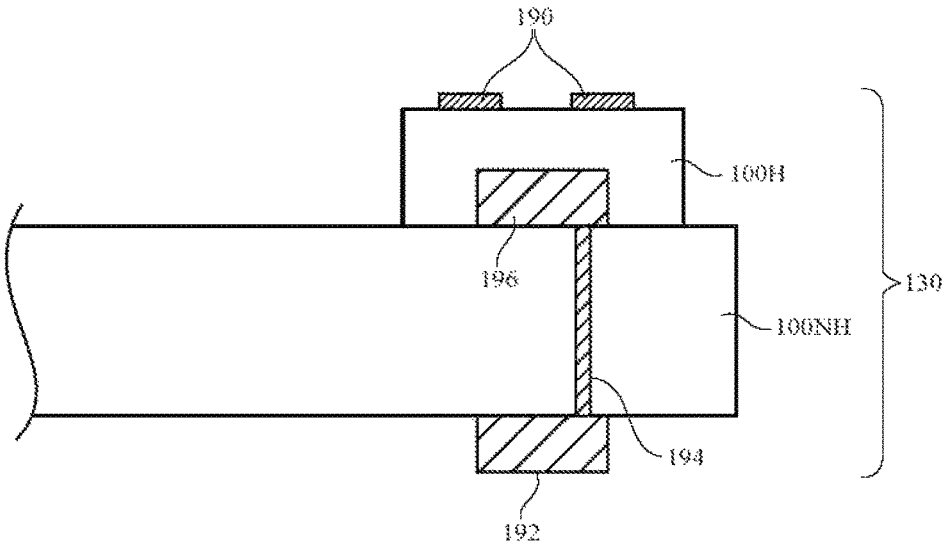
FIG. 16 is a cross-sectional side view of a portion of an illustrative stacked printed circuit having a substrate with a cavity that receives an integrated circuit in accordance with an embodiment.

The cross-sectional side view of stacked printed circuit 130 of FIG. 16 shows how one or more integrated circuits such as illustrative integrated circuit 196 may be mounted in a cavity or other interior portion of a printed circuit substrate. In the example of FIG. 16, stacked printed circuit 130 includes printed circuit substrate 100NH and printed circuit substrate 100H. Metal traces in printed circuit 130 may form antenna structures such as antenna structure 190 and 192 (resonating elements such as patch resonating elements, Yagi antenna structures such as reflectors, directors, and radiators), and other antenna structures. Vias such as via 194 may pass through portions of printed circuit 130 to couple metal traces and other antenna structures together. Integrated circuit 196 may be mounted in a recessed portion of printed circuit substrate 100H (as an example). Integrated circuits such as integrated circuit 196 may be used in forming transceiver circuitry 90 or other circuitry for device 10.

Figure 17:
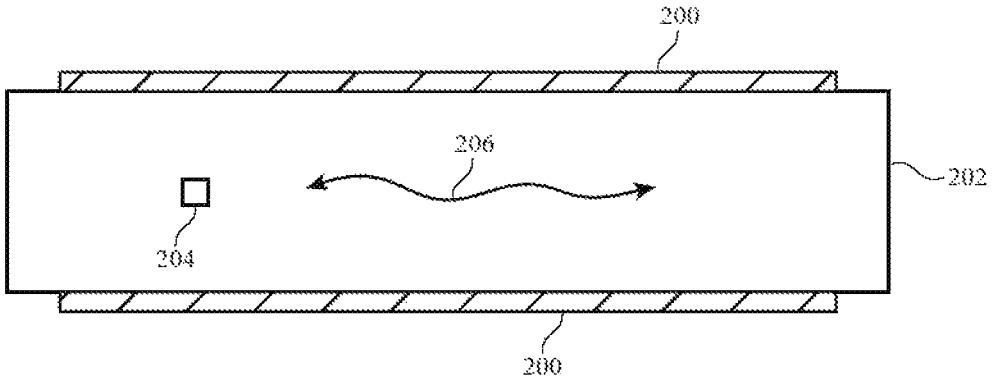
FIG. 17 is a cross-sectional side view of an illustrative antenna structure and associated waveguide in accordance with an embodiment.

If desired, antenna signal waveguide structures may be used to help convey antenna signals within device 10. An illustrative antenna signal waveguide arrangement is shown in the cross-sectional side view of FIG. 17. As shown in FIG. 17, antenna structure 204 may be embedded within dielectric member 202. Metal layers 200 may be located on the upper and lower surfaces of member 202 and may surround member 202 to form a waveguide with a rectangular cross-sectional shape. In the example of FIG. 17, layers 200 have been configured to guide antenna signals 206 horizontally within member 202. Waveguide structures with other shapes may be used, if desired.

Figure 18:
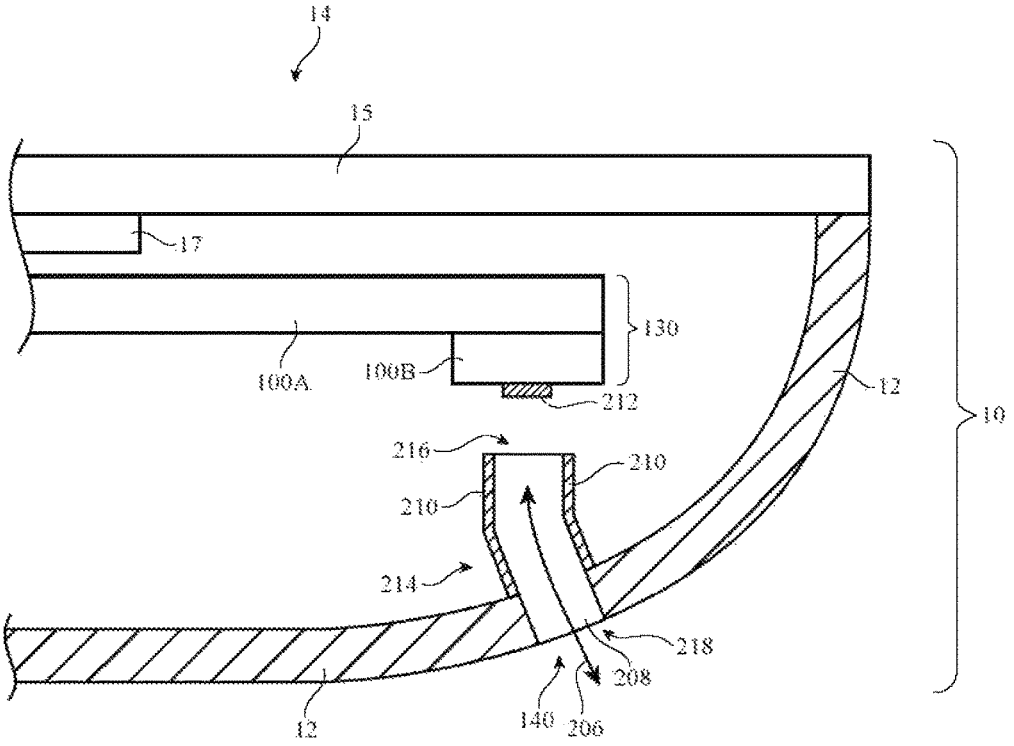
FIG. 18 is a cross-sectional side view of an illustrative antenna formed using a stacked printed circuit and an associated a waveguide that is aligned with a dielectric-filled opening in an electronic device housing wall in accordance with an embodiment.

FIG. 18 is a cross-sectional side view of an edge portion of device 10 in a configuration in which antenna signals 206 associated with antenna structure 212 are being guided using a waveguide. Antenna structure 212 may be formed from one or more traces on a printed circuit (e.g., printed circuit substrate 100B), may be formed using an antenna module attached to a printed circuit, or may be formed using other antenna structures. In the FIG. 18 example, printed circuit 130 is a stacked printed circuit that includes printed circuit substrate 100A and printed circuit substrate 100B and antenna traces (e.g., traces forming antenna structure 212) may be formed in substrates 100A and/or 100B (e.g., Yagi antenna structures, patch antenna structures, etc.).

Antenna signal waveguide 214 may be formed from a dielectric member (e.g., a plastic member) such as member 208. The side surfaces of member 208 may be surrounded with metal (see, e.g., the metal portions of housing 12 that surround portions of the sides of member 208 and metal layer 210, which surrounds portions of the sides of member 208). In the example of FIG. 18, waveguide 214 has first and second opposing ends such as ends 216 and 218. At end 216 of waveguide 214, member 208 is uncovered with metal and is aligned with adjacent antenna structures such as antenna structures 212. Antenna structures 212 may form part of a Yagi antenna (e.g., a Yagi antenna having a reflector, a radiator, and directors formed in substrates 100A and 100B of stacked printed circuit 300 or other substrate), a patch antenna, or other antenna. At end 218, member 208 is also uncovered with metal and serves as an antenna window in metal housing 12. With this type of arrangement, antenna signals 206 are guided between slot 140 in housing 12 at end 218 and antenna structures 212 (e.g., a Yagi antenna or other antenna) on printed circuit 130 at opposing end 216. Waveguide 214 may have straight portions, bent portions (e.g., curves, etc.), tapered portions, and other shapes for guiding antenna signals 206 between an antenna in the interior of device 10 and a window in housing 12 (i.e., a window exposed to the exterior of device 10). The cross-sectional shape of waveguide 214 may be rectangular, circular, oval, or other suitable shape. The use of waveguide 214 may help prevent antenna signal interactions with conductive internal device components and may enhance antenna efficiency. The waveguide arrangement of FIG. 18 may be used with a Yagi antenna (e.g., a Yagi antenna in printed circuit 130 that has directors aligned with end 216 of waveguide 214) or may be used with other antennas and/or in other locations in device 10. If desired, multiple waveguides may be formed in device 10. Each waveguide may be associated with a respective antenna. The antennas associated with the waveguides may be implemented on stacked printed circuits and printed circuits that do not include stacked substrates. The configuration of FIG. 18 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. A millimeter-wave antenna, comprising:

a first printed circuit substrate;

a second printed circuit substrate stacked on the first printed circuit substrate; and metal antenna traces forming millimeter-wave antenna structures in the first and second printed circuit substrates, wherein the millimeter-wave antenna structures include a director, a reflector, and a radiator, the director is in the second printed circuit substrate, the first printed circuit substrate has a first footprint, and the second printed circuit substrate has a second footprint that is smaller than the first footprint.

2. The millimeter-wave antenna defined in claim 1 wherein the radiator is embedded in the first printed circuit substrate and the director is embedded in the second printed circuit substrate.

3. The millimeter-wave antenna defined in claim 1 wherein the reflector is embedded in the first printed circuit substrate.

4. The millimeter-wave antenna defined in claim 1 wherein the millimeter-wave antenna structures include a patch antenna resonating element and an antenna ground.

5. The millimeter-wave antenna defined in claim 4 wherein the patch antenna resonating element is in the first printed circuit substrate.

6. The millimeter-wave antenna defined in claim 4 wherein the antenna ground is in the first printed circuit substrate.

7. The millimeter-wave antenna defined in claim 1 further comprising adhesive that attaches the second printed circuit substrate to the first printed circuit substrate.

8. The millimeter-wave antenna defined in claim 1 wherein the millimeter-wave antenna structures include a plurality of directors that are in the second printed circuit substrate and the director that is in the second printed circuit substrate is one of the plurality of directors.

9. The millimeter-wave antenna defined in claim 1 wherein the millimeter-wave antenna structures include at least one additional director that is in the first printed circuit substrate.

10. A millimeter-wave antenna, comprising:

a first printed circuit substrate;

a second printed circuit substrate stacked on the first printed circuit substrate;

metal antenna traces forming millimeter-wave antenna structures in the first and second printed circuit substrates, wherein the millimeter-wave antenna structures include a director, a reflector, and a radiator, and wherein the director is in the second printed circuit substrate; and solder that couples the millimeter-wave antenna structures in the first printed circuit substrate to the millimeter-wave antenna structures in the second printed circuit substrate.

11. An electronic device, comprising:

a housing having first and second conductive housing portions and a dielectric-filled slot that isolates the first conductive housing portion from the second conductive housing portion;

a display in the housing;

first radio-frequency transceiver circuitry configured to handle signals at frequencies between 700 MHz and 2700 MHz;

second radio-frequency transceiver circuitry configured to handle millimeter wave signals at frequencies above 10 GHz;

a first antenna coupled to the first radio-frequency transceiver circuitry, wherein the first conductive housing portion forms an antenna resonating element for the first antenna and the second conductive housing portion forms an antenna ground for the first antenna; and a second antenna coupled to the second radio-frequency transceiver circuitry, wherein the second antenna conveys the millimeter wave signals through the dielectric-filled slot.

12. The electronic device defined in claim 11, wherein the second antenna comprises a patch antenna having a patch antenna resonating element.

13. The electronic device defined in claim 11, wherein the second antenna comprises a Yagi antenna having a reflector, a radiator, and a director.

14. An electronic device, comprising:

millimeter wave radio-frequency transceiver circuitry;

antenna structures coupled to the millimeter wave radio-frequency transceiver circuitry, wherein the antenna structures include first and second antennas;

a metal housing with first and second windows;

a first waveguide that guides millimeter wave antenna signals from the first antenna to the first window in the metal housing; and a second waveguide that guides millimeter wave antenna signals from the second antenna to the second window in the metal housing.

15. The electronic device defined in claim 14, wherein the metal housing comprises metal sidewall structures and wherein the first and second windows are formed in the metal sidewall structures.

16. The electronic device defined in claim 15, wherein the first and second windows comprise dielectric-filled slots in the metal sidewall structures.

17. The electronic device defined in claim 14, wherein the first waveguide comprises a dielectric member and a metal layer that surrounds the dielectric member.

18. The electronic device defined in claim 14, wherein the first antenna comprises an antenna structure embedded in a dielectric member having upper and lower surfaces and wherein first and second metal layers are formed on the upper and lower surfaces to form the first waveguide.

19. The electronic device defined in claim 14, wherein the first and second antennas comprise first and second patch antennas having first and second respective patch antenna resonating elements.

20. The electronic device defined in claim 14, wherein the first and second antennas comprise first and second Yagi antennas, and wherein the first and second Yagi antennas each comprise a reflector, a radiator, and a director.

* * * * *